United States Patent [19]

Mollura

[11] 4,328,599

[45] May 11, 1982

[54] FIRMNESS REGULATED WATERBED MATTRESS

[76] Inventor: Carlos A. Mollura, 2824 Del Oro Pl., Fullerton, Calif. 92635

[21] Appl. No.: 52,485

[22] Filed: Jun. 27, 1979

[51] Int. Cl.[3] ..... A47C 27/08

[52] U.S. Cl. ..... 5/451; 5/458

[58] Field of Search ..... 5/451, 452, 457, 458, 5/449

[56] References Cited

U.S. PATENT DOCUMENTS

| | | | |
|---|---|---|---|
| 184,487 | 11/1876 | White | 5/451 |
| 254,265 | 2/1882 | Bone | 5/451 |
| 622,239 | 4/1899 | Lane | 5/458 |
| 660,466 | 10/1900 | Sawtell | 5/458 |
| 679,680 | 7/1901 | Langer | 5/458 |
| 684,554 | 10/1901 | Sawtell | 5/458 |
| 1,970,502 | 8/1934 | Hamza | 5/458 |
| 2,360,715 | 10/1944 | Perry | 5/458 |
| 2,919,747 | 1/1960 | Post | 5/457 |
| 3,522,123 | 7/1970 | Marchant | 5/458 |
| 3,736,605 | 6/1973 | Klein, Jr. | 5/451 |
| 3,761,974 | 10/1973 | Kuss | 5/451 |
| 4,141,770 | 2/1979 | Mollura | 5/458 |
| 4,167,795 | 9/1979 | Lambert | 5/458 |
| 4,172,301 | 10/1979 | Everard et al. | 5/457 |

FOREIGN PATENT DOCUMENTS

| | | | |
|---|---|---|---|
| 651612 | 6/1963 | Italy | 5/458 |

*Primary Examiner*—Alexander Grosz
*Attorney, Agent, or Firm*—Flam & Flam

[57] ABSTRACT

A waterbed mattress incorporates an array of individual tie structures each having an elastic element that is slightly stressed under nominal fill conditions of the mattress. The elastic element has a spring constant of about three pounds per inch. The tie structures determine the firmness characteristic of the mattress and accommodate to changing and/or shifting loads. Firmness no longer depends upon the degree of fill.

1 Claim, 10 Drawing Figures

FIRMNESS REGULATED WATERBED MATTRESS

FIELD OF INVENTION

This invention relates to waterbed mattresses and particularly, to a structure for controlling the firmness characteristics of the mattress.

BACKGROUND OF THE INVENTION

Waterbed mattress bags are generally used with a circumscribing frame so that containment and lateral support of the mass of water is sustained by a relatively sturdy structure rather than by the sheet film material of the waterbed mattress bag itself. By using a peripheral support structure, it is possible to relieve the upper layer of the mattress bag from stress whereby a person resting upon the mattress bag is supported largely by buoyancy effects and only minimally by tension of the sheet film material. Popularization of this "flotation" principle is generally attributed to Charles Hall. See, for example, his U.S. Pat. No. 3,585,356.

The top layer of the waterbed mattress bag must provide some support in order to stabilize the body of the person during rest or sleep. Furthermore, users prefer various degrees of firmness or flotation. Firmness depends upon the total load imposed upon the mattress bag. Thus, for example, if one lightweight person occupies a relatively large bed, the flotation effect is greater than if, say, two persons occupy the same bed. The flotation effect decreases and tension imposed by the top bag layer is increased.

It has been proposed to provide means for automatically adjusting the fill. See, for example, my U.S. Pat. No. 3,999,235, entitled PRESSURE EQUALIZER FOR WATERBED.

Notwithstanding precise instructions, users often overfill waterbed mattress bags in an attempt to achieve what they believe to be proper adjustment. Actually, good flotation requires that unloaded, the top layer of the bag be slightly slack. Unfortunately, the sheet film material does not have the elasticity necessary to maintain a regulated firmness for widely varying loads and widely varying degrees of fill.

Accordingly, the primary object of the present invention is to provide a structure whereby the firmness of the mattress is maintained at a substantially constant level, notwithstanding variations in the degree of fill and variations in the load imposed upon the mattress.

Another object of the present invention is to provide a firmness regulated waterbed mattress which not only achieves the foregoing object, but which, in addition, provides a "motionless" or damping characteristic by an interior baffle structure. The combination of firmness control and dampened motion achieves a desirable sensation of support and comfort.

SUMMARY OF THE INVENTION

The foregoing objectives are achieved by utilizing elastic ties between the top and bottom waterbed mattress layers that are slightly stressed under nominal fill conditions of the waterbed mattress. The ties, rather than the film plastic layers, stress the fluid. Since the plastic ties can have high stretchability or elasticity, the fluid force imposed by the ties can be regulated; that is to say, the force may be made nearly constant throughout a substantially wide range of fluid fill and/or load. Foam or other light-weight fillers are readily positioned about the ties to serve as effective damping means to retard fluid motion.

STATEMENT OF PRIOR ART

It has been common to provide substantially inelastic ties between the top and bottom layers of air cushions or mattresses in order to prevent a balooning effect. See, for example, U.S. Pat. No. 622,239 to Lane, entitled AIR BED OR CUSHION, issued Apr. 4, 1899; and U.S. Pat. No. 684,554 to Sawtell, entitled INFLATABLE ARTICLE, issued Oct. 15, 1901.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF THE PREFERRED EMBODIMENT

The following detailed description is of the best presently contemplated modes of carrying out the invention. This description is not to be taken in a limiting sense, but is made merely for purposes of illustrating the general principles of the invention, since the scope of the invention is best defined by the appended claims.

Structural and operational characteristics attributed to forms of the invention first described, shall also be attributed to forms later described, unless such characteristics are obviously inapplicable or unless specific exception is made.

Figure 1:
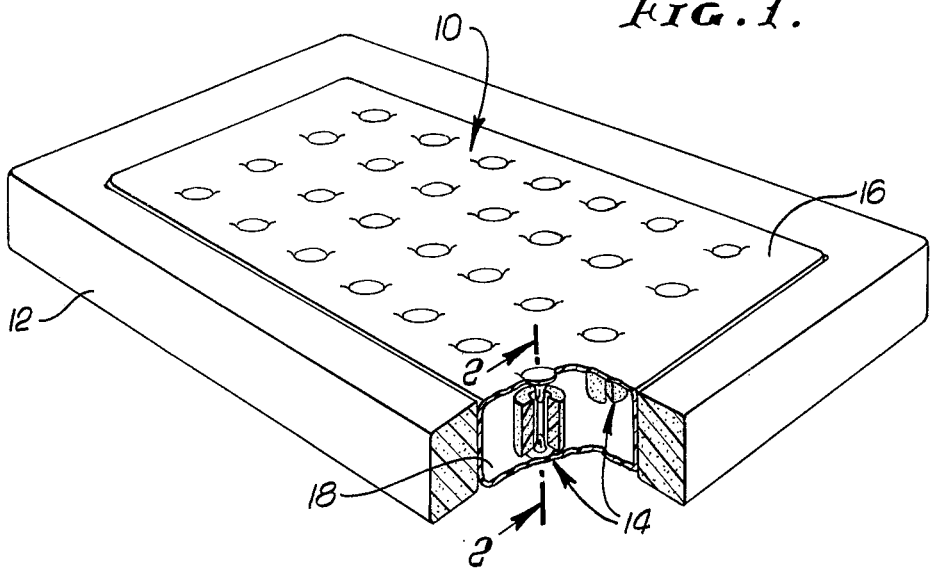
FIG. 1 is a pictorial view of a waterbed mattress bag incorporating the present invention, a corner of the bag being broken away for purposes of illustrating the inner tie structure.

In FIG. 1 there is illustrated a waterbed mattress bag 10 peripherally confined in a frame 12. The frame 12 can take any form sufficient to provide peripheral support. In the present instance, the frame is made of foam. Arrayed throughout the operative area of the mattress are a number of individual elastic tie structures 14 that connect at opposite ends to the top and bottom layers 16 and 18 of the mattress bag 10. The tie structures in the present instance are arrayed in substantially parallel rows. The specific form of array is immaterial.

Figure 2:
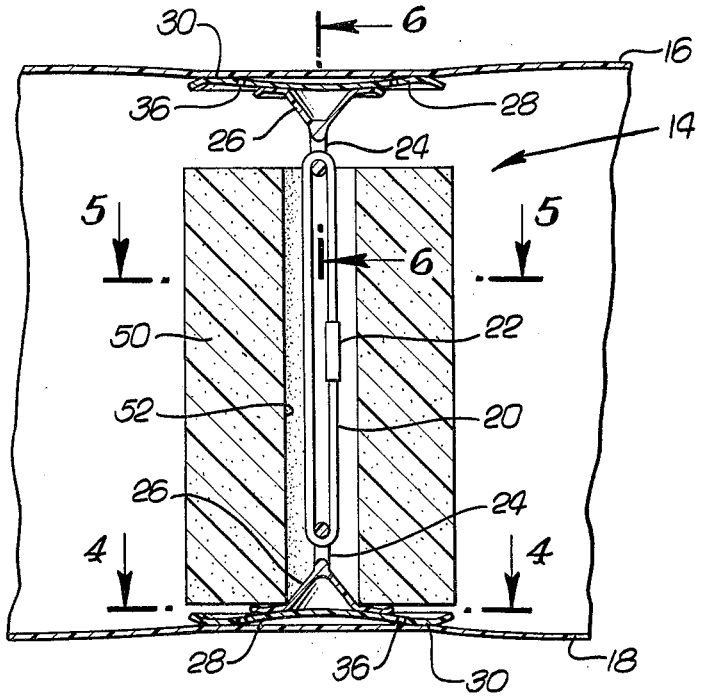
FIG. 2 is an enlarged sectional view taken along a plane corresponding to line 2—2 of FIG. 1.
Figure 3:
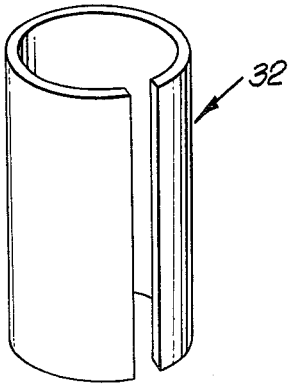
FIG. 3 is a pictorial view of a floating die structure for use in making the tie structure of FIG. 2.
Figure 4:
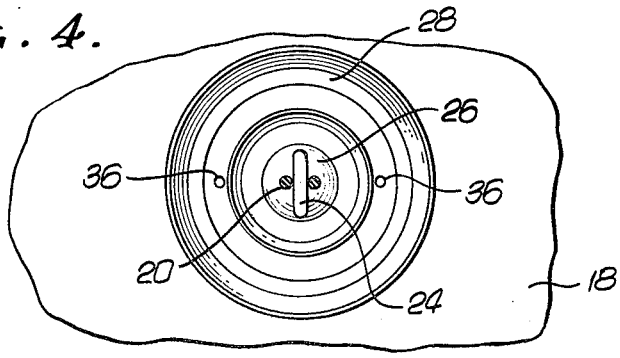
FIGS. 4 and 5 are sectional views taken along planes corresponding to lines 4—4 and 5—5 of FIG. 2.

One of the tie structures is shown in detail in FIG. 2. The tie structure consists of a loop of elastic cord 20 with its ends fastened together as by a metal crimp 22. The cord 20 is threaded at opposite ends through eyes 24 provided at the center of anchor elements 26. The anchor elements 26 are, respectively, attached in any suitable manner to circular pads 28 in turn peripherally attached to the upper and lower mattress layers 16 and 18. The anchor elements 26 are preassembled to their mounting pads 28. The pads 28 are preferably simultaneously welded along substantially circular bands 30 to the top and bottom layers as by a removable ring die 32, as shown in FIG. 3. Since the ring welded indentation is formed on the inside of the mattress, tearing, if any, at the ring weld band will not destroy the integrity of the mattress. Each of the pads 28 is provided with one or more bleed openings 36 so that fluid pressure is equalized on opposite sides of the mounting pads. Stress is thus transmitted to the mattress layers only through the weld 30. If desired, the pads 28 and the anchor disc 26 may be made as a single molded part.

As the mattress is filled with water, the slack in the individual ties is taken up. As the mattress reaches its nominal level of fill, the ties become slightly stressed. The spring constant of each of the tie structures may be of the order of three pounds per inch, thus to produce a nominal loading of two or three pounds. The stress produces slight localized indentations in the mattress bag. When the mattress is occupied, the fluid shifts. The tie structures immediately beneath the region of maximum load will become somewhat relieved, while other tie structures absorb an increasing amount of the load. A rather uniform sensation of firmness is achieved.

Figure 5:
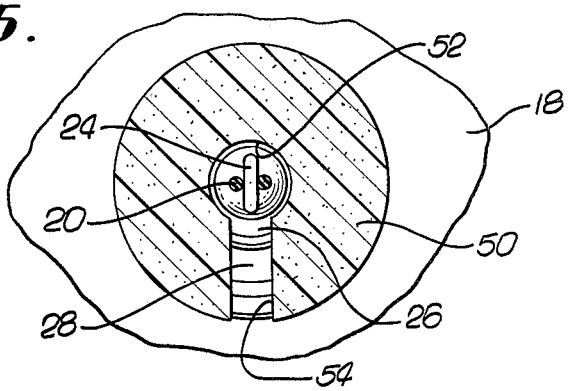

In order to damp wave motion, thereby to provide a "motionless" effect, individual baffles 5Q (see also FIG. 5) are installed about the tie structures 14. The baffles 50 are flexible, lightweight porous foam such as polyurethane. Each baffle is substantially cylindrical in form with a height somewhat less than the nominal fill thickness of the mattress bag. Each baffle is provided with a small axial passage 52 and a keyhole slot 54 leading to the axial passage 52 whereby the baffle can be slipped into place.

DETAILED DESCRIPTION OF ALTERNATIVE EMBODIMENTS

Figure 6:
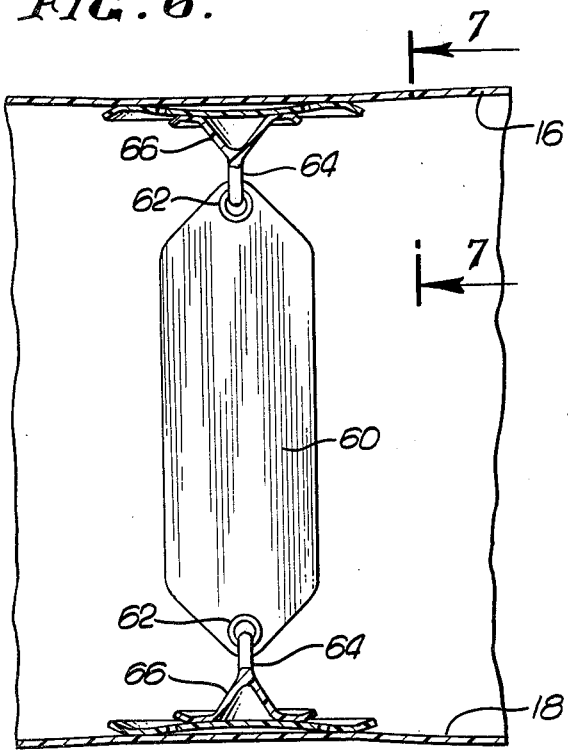
FIG. 6 is a sectional view similar to FIG. 2, illustrating a modified form of the present invention.
Figure 7:
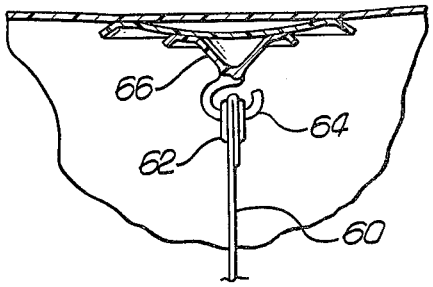
FIG. 7 is a fragmentary sectional view taken along a plane corresponding to line 7—7 of FIG. 6.

In the form of the invention shown in FIG. 6, an elastic web structure 60 is provided in place of a looped cord. The web has grommets 62 at opposite ends that directly or indirectly connect with hook structures 64 (FIG. 7) provided by anchor discs 66. The hook structure 64 preferably has a restricted access in order releasably to retain the grommets in position. A baffle structure (not shown) may be installed about the elastic web 60 as desired.

Figure 8:
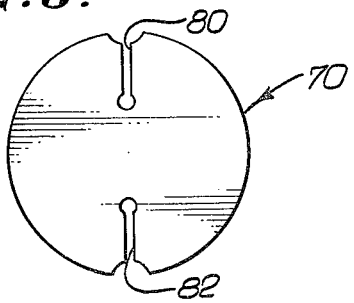
FIG. 8 is a plan view of another modified tie structure prior to its attachment to the waterbed mattress layers.
Figure 9:
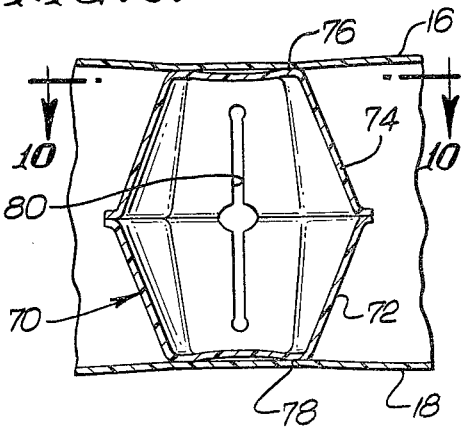
FIG. 9 is a vertical sectional view similar to FIG. 2 and showing the tie of FIG. 8 in place.
Figure 10:
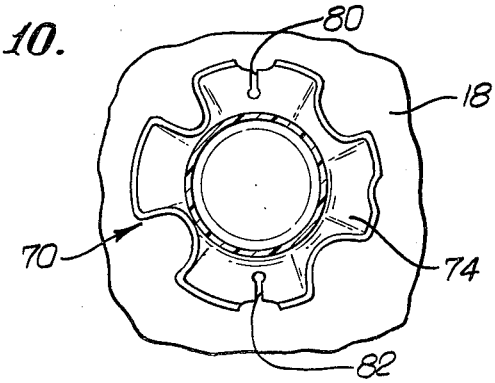
FIG. 10 is a transverse or horizontal sectional view taken through the tie structure of FIG. 9, the bottom layer of the mattress being broken away around the tie structure.

In the form of the invention shown in FIGS. 8, 9 and 10, an open pancake bladder structure 70 is provided. The bladder 70 is in the form of juxtaposed discs 72 and 74 (FIG. 8) peripherally secured together in any suitable fashion. The individual discs are identical in shape and size to those shown and described in my copending application with Lloyd D. Everard entitled FLUID FILLED BEDS AND THE LIKE, Ser. No. 865,995, filed Dec. 30, 1977, now U.S. Pat. No. 4,172,301. However, the discs are made of resilient, highly elastic material. The discs are shown as made of sheet material. However, they may be fabric woven of elastic filament. In any event, the respective discs are attached to the top and bottom mattress layers along circular bands 76 and 78. The bands have a diameter of about half that of the discs. This allows the bladder to assume a biconical form as depicted in FIGS. 9 and 10. Openings 80 and 82 in the discs allow slightly restricted passage of fluid into and out of the bladder for damping effects, as described in said copending application. Upon increased fill or imposition of load, the bladder structure 70 does not positively limit mattress layer separation, but instead, imposes a yielding elastic restraint thus to provide a controlled firmness. The spring constant of the bladder may be approximately the same as that provided by the previous forms.

Intending to claim all novel, useful and unobvious features shown or described, I make the following claim:

1. A waterbed mattress for use with a waterbed frame comprising:

(a) impervious plastic sheet material forming a top mattress layer and a bottom mattress layer;

(b) a plurality of individual tie structures arrayed about the operative area of the mattress;

(c) each tie structure including a resilient and highly elastic element anchored at opposite ends of the respective mattress layers;

(d) each tie structure having a low spring constant thus to yield as the top layer bulges upwardly under the load of an occupant or under the load of water fill;

(e) each of the elastic elements being stressed when the mattress, peripherally confined by the frame, is filled with water beyond a nominal level whereby said elastic ties impose stress upon the said upper mattress layer resisted by the volume of fluid in the mattress thereby to determine the firmness characteristic of the mattress; and (f) a substantially cylindrical baffle located about the said elastic element of each tie structure, each baffle having a keyhole slot for placement after the tie structure is attached to the top and bottom layers.

* * * * *